United States Patent [19]

Lussier

[11] 4,078,333

[45] Mar. 14, 1978

[54] SWINGING DOOR SYSTEM

[76] Inventor: Jean Louis Lussier, 91 Francois-Gauthier, Boucherville, Quebec, Canada, J4B 4NJ

[21] Appl. No.: 781,679

[22] Filed: Mar. 28, 1977

Related U.S. Application Data

[63] Continuation-in-part of Ser. No. 668,198, Mar. 18, 1976.

[51] Int. Cl.[2] ..... E05C 15/02

[52] U.S. Cl. ..... 49/141; 49/393

[58] Field of Search ..... 49/141, 44, 390, 393, 49/392; 312/138, 283, 326

[56] References Cited

U.S. PATENT DOCUMENTS

| | | | |
|---|---|---|---|
| 2,025,958 | 12/1935 | Schreiber | 49/44 |
| 2,530,263 | 11/1950 | Peremi et al. | 49/141 |
| 2,576,854 | 11/1951 | Peremi et al. | 49/141 |
| 2,849,761 | 9/1958 | Puidak | 49/390 |
| 3,445,963 | 5/1969 | Gilbert et al. | 49/141 |
| 3,793,773 | 2/1974 | Sheckells | 49/141 X |

*Primary Examiner*—Philip C. Kannan
*Attorney, Agent, or Firm*—Francis J. Lidd

[57] ABSTRACT

A door system of the swinging type to neutralize air draft effects on the door, which is conceived to allow panic exit and to psychologically induce the user to pivot the latter in a predetermined direction. This door system includes a pair of wings or panels having a releasable magnetic connection allowing normal bodily pivoting of the two wings as a simple swinging door and also allowing, for instance under panic, outward opening of the wing which normally opens inwardly. This door system includes a stopper and a door frame relatively arranged to define an oblique closing position for the door, and also includes a resilient strip of adjustable resilience engaging the stopper to prevent inadvertent opening of the panic wing.

2 Claims, 14 Drawing Figures

SWINGING DOOR SYSTEM

This application is a continuation-in-part of Application Ser. No. 668,198, filed on Mar. 18, 1976 for the same inventor.

This invention relates to a door or door system and, in particular, to a door system particularly adapted for public places and of the swinging type to eliminate the effect of air drafts which oppose substantial resistance to the handling of a conventional laterally hung door.

The doors of public buildings, in particular of subway stations, must fulfill definite requirements to find acceptance. One such requirement concerns the ability of such door to allow panic exit of people with as little hindrance as possible.

It is a general object of the present invention to provide a door and a door system of the above swinging type which are suited to meet the requirements for public places, and more particularly, which, while not adversely affected by air drafts acting thereon, are satisfactory for panic exit of people.

It is another general object of the present invention to provide a door and a door system of the above type, which are of the swinging door type and are arranged to psychologically induce the users to instinctively pivot the door in the predetermined direction of opening.

It is a more specific object of the present invention to provide a door and a door system of the above type, wherein the door is held in such closed position that the users will naturally instinctively be induced to pivot it in one particular angular direction.

It is a further object of the present invention to provide a door system of the above type, wherein the door closes in an oblique position relative to the plane of the door frame and, thus apparently, induces in the user's mind that the door is partly open or opening in that particular direction and should therefore be pushed to pivot still farther in the same direction to open the door while avoiding counteracting the effort or work already done.

It is another object of the present invention to provide a door and a door system of the swinging type, wherein the door has a pair of wings substantially extending on the opposite sides of the pivot axis thereof, with a connection between the two wings which allows folding of the latter of the two upon pushing in the same outward direction on both wings, such as by people seeking panic exit through this door.

It is another object of the present invention to provide a door and a door system of the swinging type wherein the door is provided with a resilient member adapted to resiliently give against a stopper upon impact against the panic wing of the door in order to prevent inadvertent opening of the panic wing while allowing folding of the two door wings upon steady unidirectional push on both wings.

The above and other objects and advantages of the present invention will be better understood with the following detailed description of a preferred embodiment thereof which is illustrated, by way of example, in the accompanying drawings, wherein.

Figure 3:
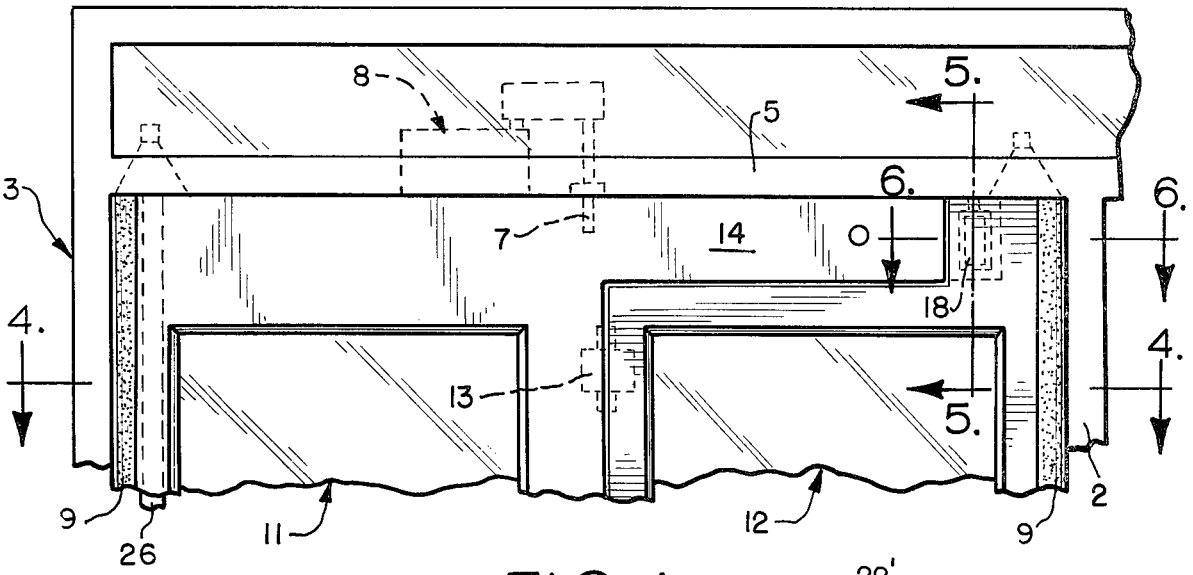
FIG. 3 is a partial elevation and a more detailed view of the swinging door system of FIG. 1.
Figure 5:
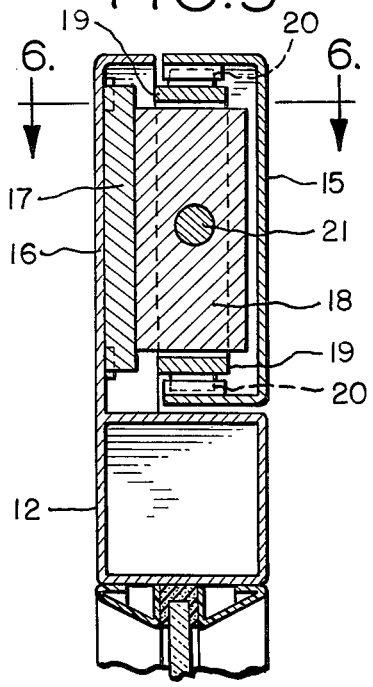
Figure 6:
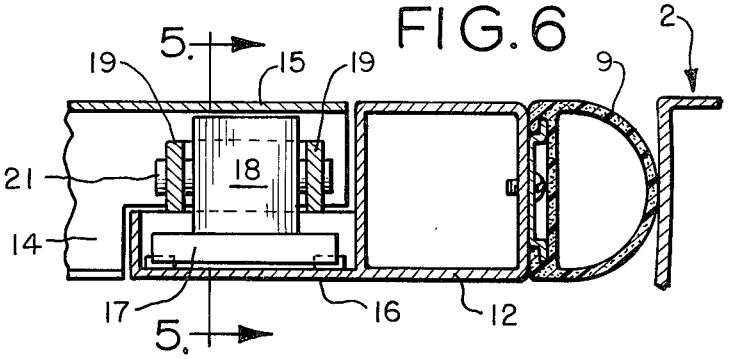
Figure 6A:
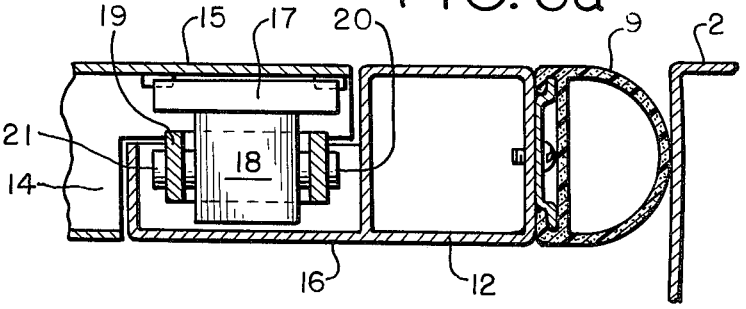

FIGS. 5 and 6 are cross-sectional views as seen along lines 5—5 and 6—6 respectively in FIG. 3;

FIG. 6*a* is a cross-sectional view of an alternate embodiment as seen along line 6—6.

Figure 1:
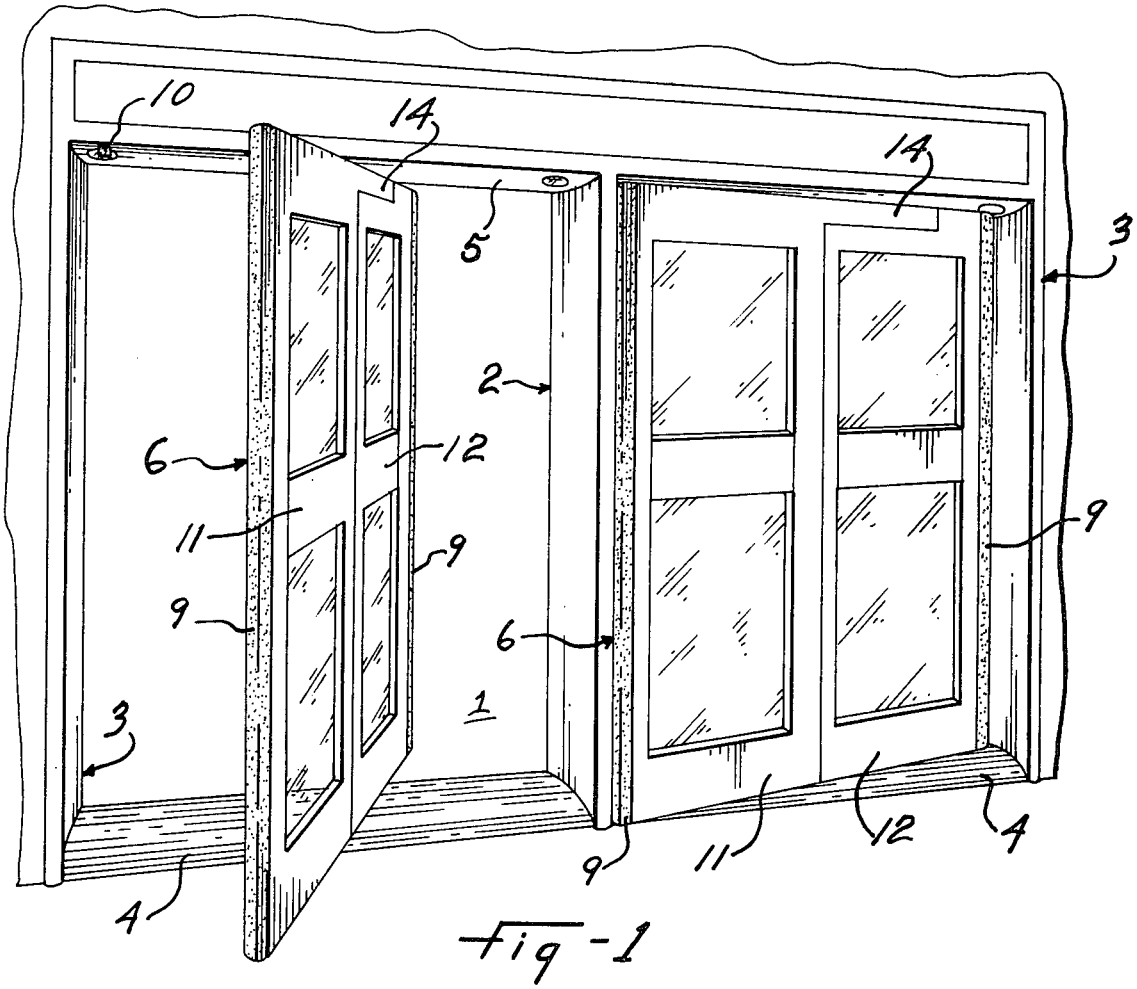
FIG. 1 is a perspective view of a swinging door system according to the present invention illustrating the normal opening of a door shown from the outside.
Figure 7:
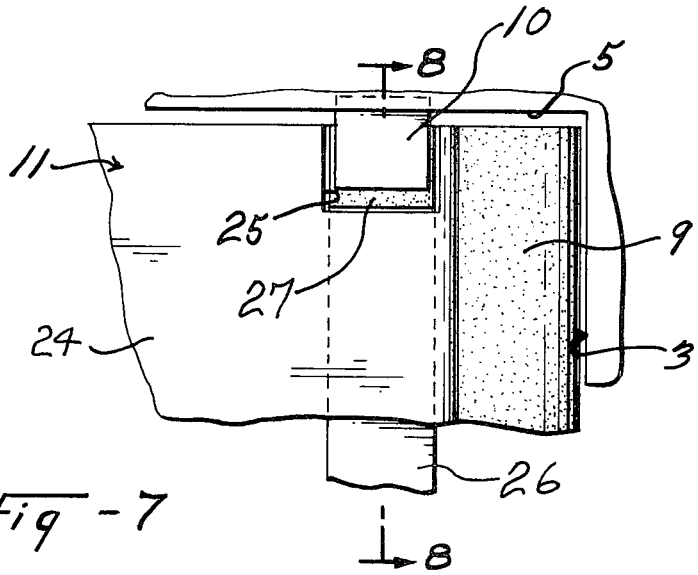
Figure 8:
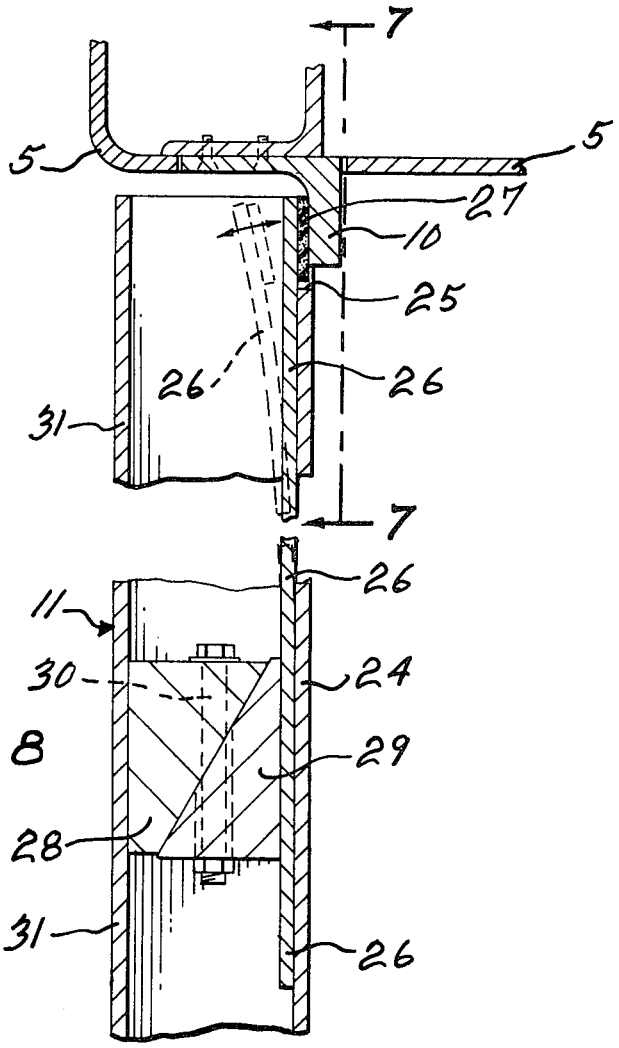
Figure 9:
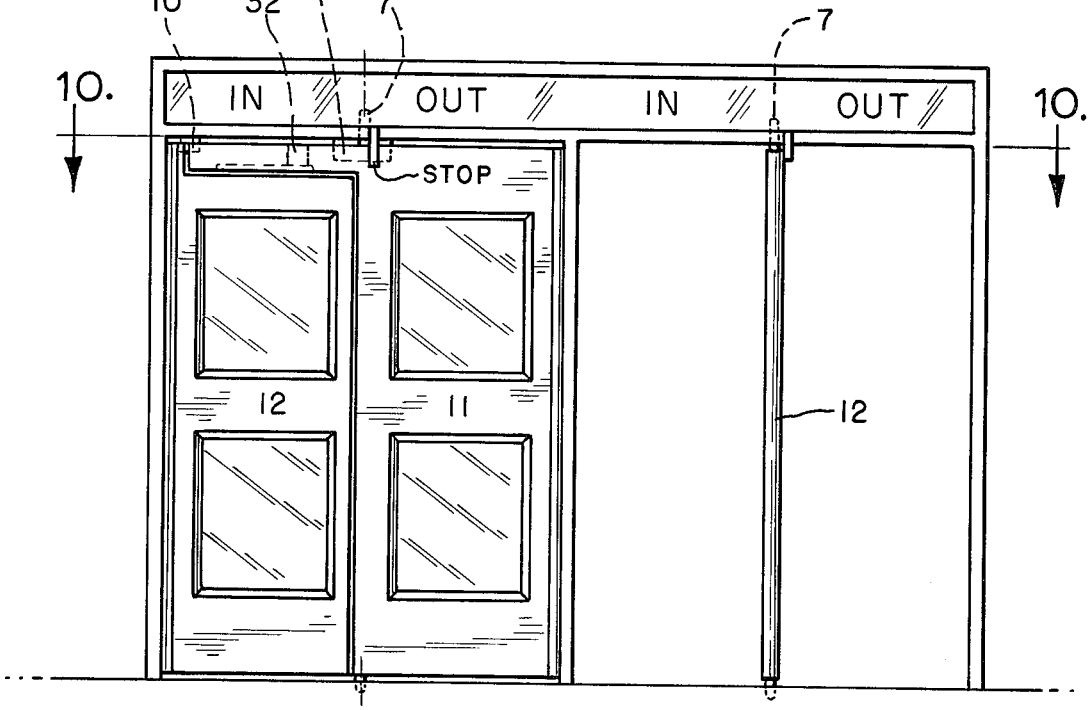
Figure 10:
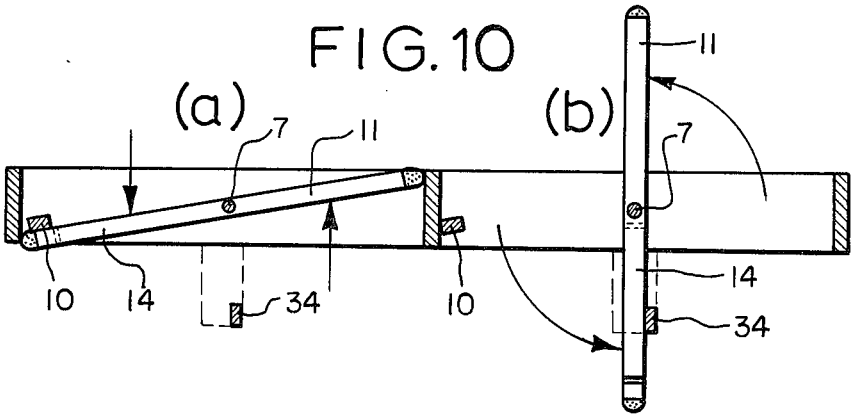
Figure 11:
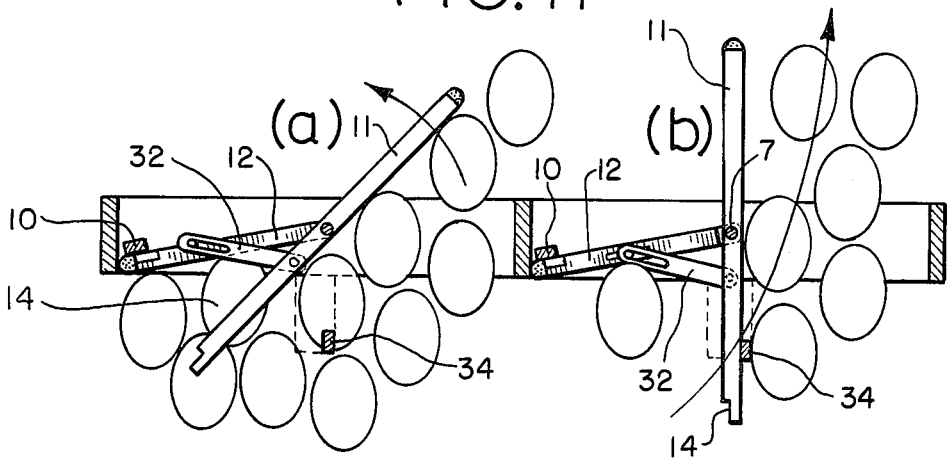
Figure 12:
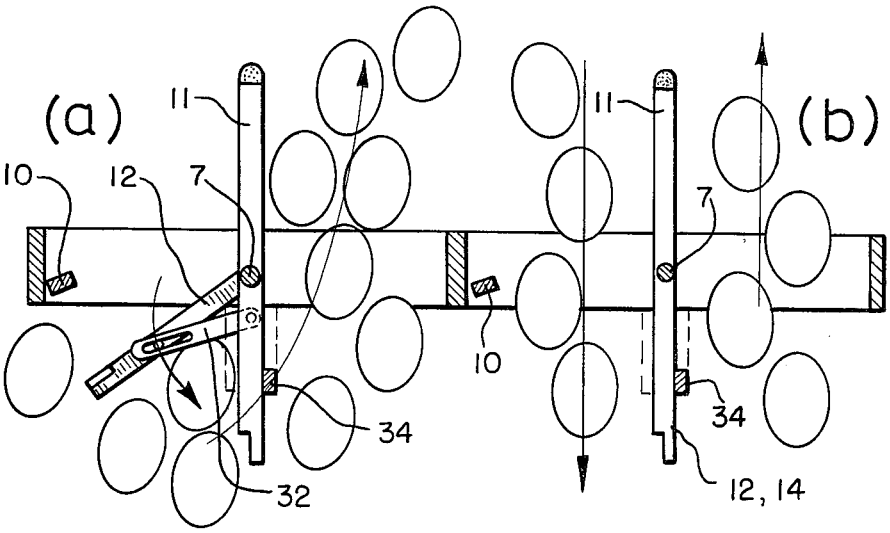

FIG. 7 is a detailed view of the top right corner of the main door wing as seen from the interior side; and FIG. 8 is a cross-sectional view as seen along line 8—8 in FIG. 7;

FIG. 9 is an inside view of an alternate embodiment of the door system shown in FIG. 1;

FIG. 10 is an overall diagrammatic section view of the door system of FIG. 9 as seen from the inside along the lines 10—10;

FIG. 10*a* is a sectional diagrammatic view of the left hand door of FIG. 10 with the door panel in the normal or closed position;

FIG. 10*b* is a sectional diagrammatic view of the right hand door of FIG. 10 with the door panel in a normal or non-power open position;

FIG. 11 is a diagrammatic sectional view of the door system of FIG. 9 as seen from the inside along lines 10—10, wherein;

at (a), panic operation is initiated causing the panels 11, and 12 to separate in order to allow one way traffic thru the right hand panel 11;

at (b), full panic operation is shown wherein panels 11 and 12 are fully separated for one-way traffic FIG. 12 is a sectional diagrammatic view of the door system of FIG. 9 along lines 10—10, wherein;

at (a), panic or emergency traffic has begun to ebb, and arm, 32 of resilient means 38 has begun to restore a co-planer relationship to panels 11 and 12.

at (b), panic traffic has totally subsided, and door panels 11, 12 are fully co-planer, allowing a resumption of two-way traffic.

Figure 13:
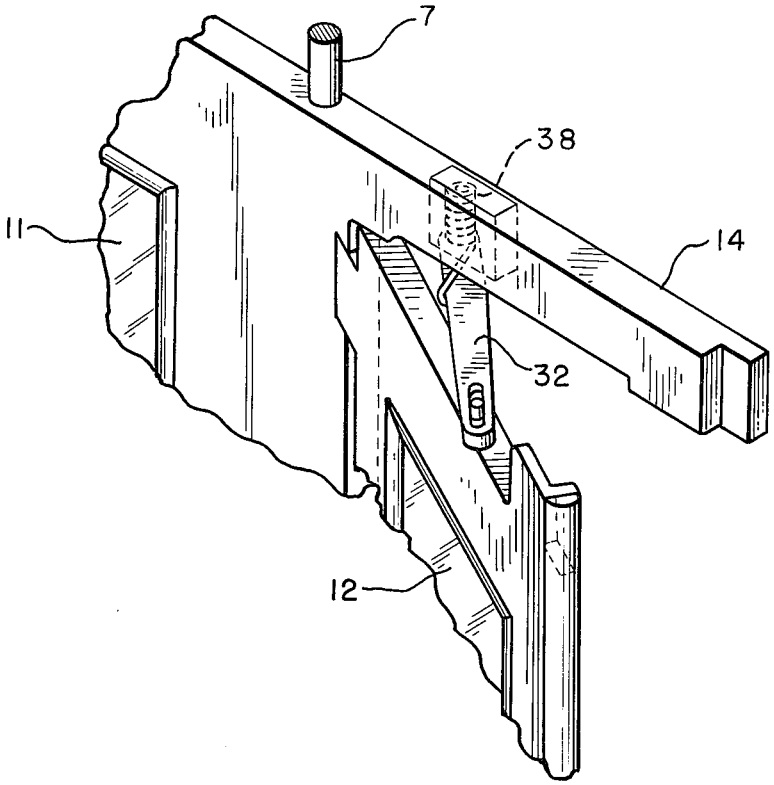

FIG. 13 is a partial view of wings 11, and 12 with resilient means 34 in position.

Figure 2:
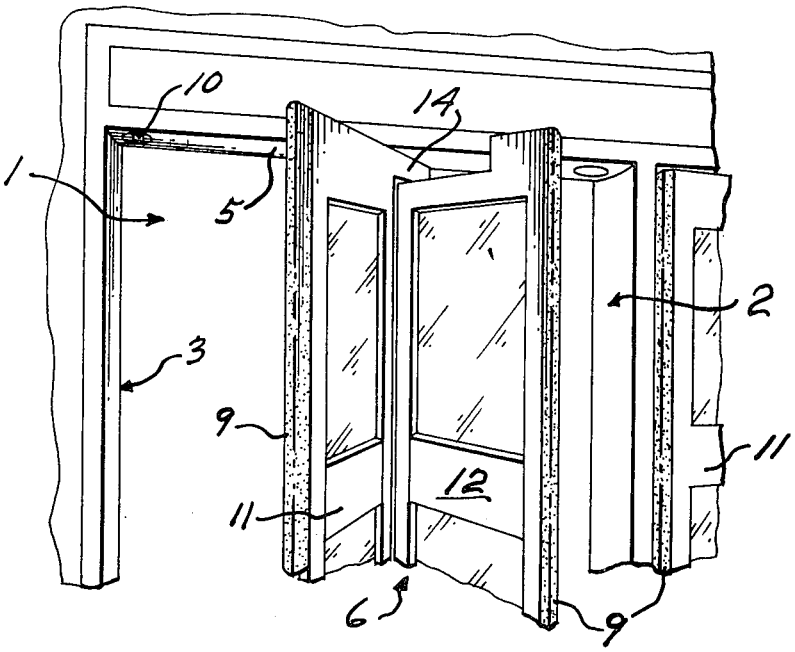
FIG. 2 is a partial view of the panic door system of FIG. 1 illustrating folding of the wings of a door, such as in responsive-to-panic action of a crowd thereon.

The illustrated swinging door system as seen in FIGS. 1 and 2 defines a two-door unit. As it will be easily understood, the invention is applicable also to a single door unit and to a door unit having any number of doors.

The illustrated two-door unit includes a door frame forming two door openings 1 defined by an intermediate common door jamb 2 and external door jamb 3 and each with a door sill 4 and a top member 5. A swinging door 6 is pivotally mounted in each door opening 1.

Figure 4:
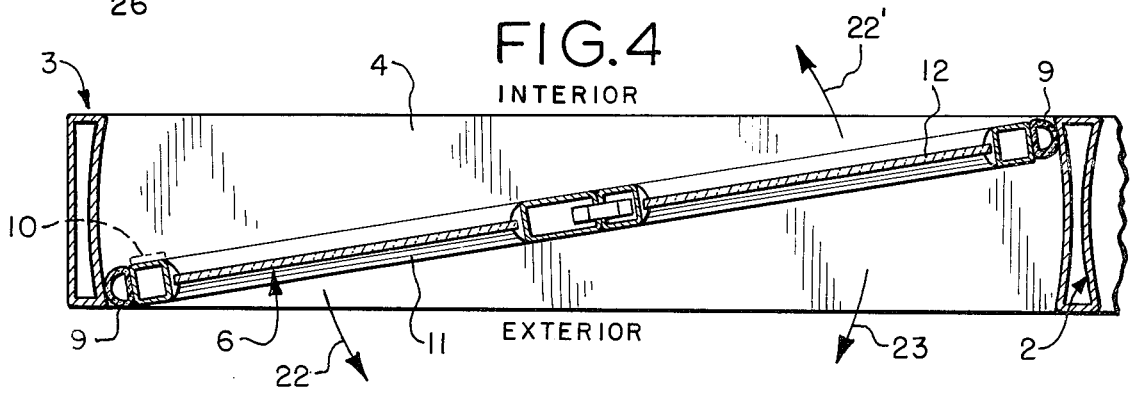
FIG. 4 is a cross-section as seen along line 4—4 in FIG. 3.

It must be noted that the door frame is relatively thicker than usual, as best shown in FIGS. 1 and 4. Thus, each door opening 1 is as defined by a relatively wide internal perimeter of the door frame. In other words, the internal perimeter of the door frame around each door opening is substantially wider than usual for the selected thickness of the door. Each door 6 is pivoted by pivot means or a pin 7 and an additional pivot located in the sill 4 about an upright pivot axis located between the opposite upright edges of the door and essentially midway to the width of the internal door frame perimeter, or in other words, to the width of the sill 4 and the top member 5. A door closure mechanism or device 8, of any appropriate type, is connected to the pin 7 to produce closing of the associated door 6.

The opposite upright edges of each door 6 are provided with an edge flexible strip 9. The internal peripheral face of each door jamb 2 and 3 is arcuately shaped relative to the pivot axis of the corresponding door. Flexible strips 9, of rubber or the like, on the door edge prevent finger pinching between the door jambs and the door edges and serve as padding injury to people.

The top member 5 at the top left corner of each door opening 1 is provided with a downwardly projecting stopper member 10. In order to stop the corresponding door in an oblique closing position relative to the door frame, as shown on the right pair of wings in FIG. 1 and in FIG. 4, the stopper 10 is offset inwardly relative to the position it would have to allow normal co-planer closing of the door relative to the door frame. As best shown in FIG. 4, when the stopper 10 is engaged by the door 6, the latter is in an oblique closing position with left edge strip 9 opposite the exterior edge of the left door jamb and the right edge strip 9 opposite the interior of the right door jamb.

It is well known that in such oblique closing position, people moving through the door are naturally induced to push on the farthest side of the door and, thus, instinctively open the door angularly away from the stopper 10.

Each door 6 includes a pair of wings or panels, namely main wing 11 and panic wing 12. The main wing 11 is provided with the aforementioned pins 7 which define the upright pivot axis for the whole door 6. The panic wing 12 is hinged at 13 to the main wing 11. The wings 11 and 12 of each door 6 are arranged in edgewise adjoining relationship at the hinge 13, such that they are co-planer when they bodily pivot, as shown on the left in FIG. 1.

The main wing 11 is integrally formed with an arm 14 projecting from the hinged edge of the wing 11 at the top of the latter. As shown in FIG. 6, the outer end of the projection 14 forms a thinner portion 15 having an edge overlapping a mating thinner portion 16 of the panic wing 12, the members 14 and 16 cooperating to form the opposite side walls of the door confining the internal space of the door. A metal plate 17 is fixed against the internal side of the portion 16 and a permanent magnet 18 is mounted inside the portion 15. The permanent magnet 18 is universally pivotally attached to the portion 15 by a gimbal ring 19 and pivots 20 and 21. Thus, the magnet 18 is allowed to align itself flat against the fixed plate 17 providing a releasable connection between members 14 and 16.

Referring to FIG. 6*a*, an alternate embodiment of the releasable connection utilizes the magnet 18, gimbal ring 19, and pivots 20, 21 contained in panic wing 16. The metal place 17 is fired against the outer edge 15 of the wing projection 14.

Thus, the magnetic connection formed by the plate 17 and magnet 18 is wholly concealed within the thickness of the door and normally maintains the two wings 11 and 12 into engagement when net forces applied to wings 11 and 12 for bodily pivoting of the latter about pivot pins 7 in accordance with arrows 22, 22'. However, when predetermined forces are outwardly applied in the direction of the arrows 22 and 23 in FIG. 4, against both wings of a door, the magnetic force exerted between the magnet 18, and plate 17 is overcome, and the wings fold, as shown in FIG. 2. Thus, panic exit is readily allowed by mere outward pushing on both wings.

Folding of the two wings obviously also occurs when an outward push is exerted on panic wing 12 only, in which case main wing 11 remains in abutment with stopper 10.

As shown in FIG. 7, the internal side wall 24 of main wing 11 is formed with an aperture 25 registering with the stopper 10 downwardly projecting from the top member 5 of the door frame. The aperture 25 thus gives access to the stopper 10 into the hollow space of the main wing 11. A resilient strip 26 is positioned upwardly against the internal face of the side wall 24 and has its top end and registering with the aperture 25. A bumper pad 27 is fixed against the top end of the strip 26 on the side of the latter which faces the stopper 10. A pair of wedge blocks 28 and 29 are releasably wedged by a bolt 30 between the external side wall 31 of the wing 11 and the strip 26. The resilience of the resilient strip 26 may be adjusted by adjusting the position of the wedge blocks 28 and 29 along the strip. Strip 26 prevents intempestive opening of panic wing 12 upon impact applied against the inside face thereof. Such impact is absorbed by the bending of strip 26 against stopper 10 and, thus, separation of plate 17 from permanent magnet 18 is prevented. Separation of plate 17 from permanent magnet 18 will occur only when a sufficient outward firm push is applied.

In the normal use of the door, and referring to FIG. 1, outward traffic is effected through the left portion of the door frame and inward traffic is effected through the right portion of the door frame.

It is noted that door stopper 10 could be located to abut the outside face of arm 14 of main wing 11 and that impact absorbing strip 26 could be positioned horizontally in arm 14 with its bumper pad 27 opposite the stopper 10.

Another mode of operation is also possible, as shown in FIGS. 9, 10, 11*a*, 11*b*, 12*a*, 12*b*. Stopper 10 would be located to abut the outside face of panic wing to thus prevent outward opening of this wing 12. An additional stopper 34 located above the panic wing 12, contacts the projection 14 limiting opening of the door and/or projection 14 to the position shown in FIG. 10*a*. A resilient means would be connected to the two wings to resiliently urge the two wings 11 and 12 into co-planar relationship maintained during swinging operation as shown at FIG. 10*a* and FIG. 10*b*. Normal traffic through the door opening would be as above noted. For panic use, people wishing to go outwardly would first open the main wing only, as shown in FIG. 11, where wing 12 and arm 14 are displaced, being induced to do so by the inclination of the door in its closed position. Normal traffic would be established, as indicated sequentially in FIG. 12, at (a) and (b) where outward pushing on panic wing 12, no longer taking place due to traffic movement through the main wing, the panic wing would then spring open under action of the above-noted resilient means to allow outward traffic through the right as well as the left portion of the door opening wings 11 and 12 having returned to a co-planar position.

A portion of the alternate embodiment showing a preferred but not exclusive configuration utilizing resilient re-set means 32 located to provide separation of the panic wing 12 and wing 11, and subsequent return to co-planar relationship is shown in FIG. 13. As shown, the lever 36 is actuated by an internal spring means 28, and acts on the slide 40, to urge wing 12 under the horizontal member 14.

Thus it is apparent that there has been provided, in accordance with the invention, a door system providing two way normal traffic providing increased one way traffic under emergency conditions that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

The invention is hereby claimed as follows:

1. A swinging door system comprising; a door frame having a door opening, a door including first and second wings hinged together about an upright hinge axis, releasable connection means carried by said wings and maintaining said wings in substantially co-planar relation, comprising an integral rigid arm on said first wing extending transversely of said upright hinge axis along the top edge of said second wing, said second wing having an upright projection at its top edge overlapping said arm, two opposite upright edges of said door defined by said first and second wings respectively, pivot means pivotally securing said first wing of said door to said door frame in said door opening for pivotal movement of said door about an operatively upright pivot axis equally distant from the opposite upright edges of said door, a stopper secured to said door frame in the path of said second wing to prevent outward opening of the same, and means resiliently inter-connecting said first and second wings and urging said first and second wings with co-planar relationship, and a door closing device yieldingly urging pivotal closing of said door against said stopper wherein said releasable connection automatically releases said substantially co-planer wings for folding movement of said first wing about said hinge axis upon sufficient force exerted simultaneously on said first and second wings in the respective direction of opening said first wing and closing said second wing of said door.

2. In a swinging door assembly for two-way pedestrian traffic having;

a door frame having a top and bottom, and vertical sides;

a door having upper and lower edges, and two wings each having inner and outer vertical edges;

a hinge connecting said wings along said inner vertical edges;

pivot means attached to said top and bottom edges of and essentially centered on said door;

means mounting said door and pivots to said frame top and bottom to allow said door to swing open and closed about a vertical axis essentially centered between said vertical door frame sides;

resilient connection means mounted on and maintaining said wings in restorable co-planer relationship about said hinge;

a door stopper attached to said frame for selectively preventing the passage of one wing through said frame in one direction;

a door closer for urging said door to swing closed and maintaining a residual force against said stopper;

wherein said resilient means, door stopper, hinge and door pivots cooperate to fold said door wing about said hinge when simultaneous force is applied to both wings in said one direction and subsequently restoring said wings to said co-planer relationship on cessation of said force applied to said one wing providing one-way traffic through said door under emergency conditions.

* * * * *

UNITED STATES PATENT OFFICE

CERTIFICATE OF CORRECTION

PATENT NO. : 4,078,333

DATED : March 14, 1978

INVENTOR(S) : Jean Louis Lussier

It is certified that error appears in the above-identified patent and that said Letters Patent are hereby corrected as shown below:

Col. 3, lines 21-22, should read "the interior edge of the right door jamb";

Col. 4, line 68, should read "spring means 38";

Col. 5, line 36, "with" should read "into".

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*